US007562909B2

(12) United States Patent
Luft et al.

(10) Patent No.: US 7,562,909 B2
(45) Date of Patent: Jul. 21, 2009

(54) COMPOSITE LOW CYCLE FATIGUE COILED TUBING CONNECTOR

(75) Inventors: Hans-Bernd Luft, Calgary (CA); Lyle Erwin Laun, Sandnes (NO)

(73) Assignee: BJ Services Company, Houston, TX (US)

( * ) Notice: Subject to any disclaimer, the term of this patent is extended or adjusted under 35 U.S.C. 154(b) by 89 days.

(21) Appl. No.: 11/315,802

(22) Filed: Dec. 22, 2005

(65) Prior Publication Data

US 2006/0157974 A1 Jul. 20, 2006

Related U.S. Application Data

(63) Continuation of application No. 10/394,392, filed on Mar. 21, 2003, now abandoned.

(51) Int. Cl.
*F16L 21/00* (2006.01)

(52) U.S. Cl. ..... 285/237; 285/235; 285/417; 166/241.6

(58) Field of Classification Search ..... 285/370, 285/397, 417, 235, 236, 237; 166/241.3, 166/241.6, 241.1
See application file for complete search history.

(56) References Cited

U.S. PATENT DOCUMENTS

| | | | | | |
|---|---|---|---|---|---|
| 1,817,772 | A | | 8/1931 | Sipe | |
| 2,066,473 | A | | 1/1937 | Berg | |
| 2,536,216 | A | | 1/1951 | Baden | |
| 2,664,272 | A | | 12/1953 | Boice | |
| 3,080,926 | A | * | 3/1963 | Remp, Jr. | 166/241.6 |
| 3,907,341 | A | | 9/1975 | Schoepe | |
| 4,208,055 | A | | 6/1980 | Noensie et al. | |
| 4,303,103 | A | * | 12/1981 | Marks et al. | 285/370 |
| 4,457,543 | A | | 7/1984 | Justus | |
| 4,470,621 | A | | 9/1984 | Irvine | |
| 4,564,220 | A | | 1/1986 | Sills et al. | |
| 4,844,516 | A | | 7/1989 | Baker | |
| 5,033,558 | A | * | 7/1991 | Russo et al. | 175/325.3 |
| 5,251,695 | A | | 10/1993 | Coronado | |
| 5,306,050 | A | * | 4/1994 | Laflin et al. | 285/119 |
| 5,348,088 | A | | 9/1994 | Laflin et al. | |
| 5,425,420 | A | | 6/1995 | Pringle | |

(Continued)

FOREIGN PATENT DOCUMENTS

| | | |
|---|---|---|
| DE | 3728034 | 3/1989 |

(Continued)

OTHER PUBLICATIONS

B D Kendle Engineering Limited, Coiled Tubing Products; www.bdkendle.co.uk; Sec. 3 of 14; p. 6-13.

*Primary Examiner*—David E Bochna
(74) *Attorney, Agent, or Firm*—Zarian Midgley & Johnson PLLC

(57) ABSTRACT

A coiled tubing connector having a body and a plurality of entry or transition sections connected to the body wherein the connector has a low cycle fatigue life of at least 30%, more preferably at least 50% of the coiled tubing. A preferred embodiment contains two shoulders that form an annular void, a plurality of centralizers about an exterior of the body, and/or a plurality of elastomer molds separating the centralizers. The connector is preferably longer than the connectors of the prior art and is a composite of fluoroplastics or aluminum alloys.

20 Claims, 2 Drawing Sheets

U.S. PATENT DOCUMENTS

| | | | | |
|---|---|---|---|---|
| 5,452,923 | A | 9/1995 | Smith | |
| 5,522,467 | A * | 6/1996 | Stevens et al. | 175/73 |
| 5,524,937 | A * | 6/1996 | Sides et al. | 285/370 |
| 5,988,702 | A | 11/1999 | Sas-Jaworsky | |
| 6,264,244 | B1 | 7/2001 | Isennock et al. | |
| 6,439,618 | B1 | 8/2002 | Beeman et al. | |
| 6,474,701 | B1 | 11/2002 | Bowles et al. | |
| 6,481,498 | B1 | 11/2002 | Ackroyd et al. | |
| 6,561,278 | B2 | 5/2003 | Restarick et al. | |
| 6,679,325 | B2 * | 1/2004 | Buytaert | 166/241.3 |
| 6,830,102 | B2 * | 12/2004 | Kirk et al. | 166/241.6 |
| 7,395,881 | B2 * | 7/2008 | McKay et al. | 175/325.3 |

FOREIGN PATENT DOCUMENTS

| | | | |
|---|---|---|---|
| EP | 0 897 502 | B1 | 4/2002 |
| GB | 2 274 891 | A | 8/1994 |
| GB | 2 328 262 | A | 2/1999 |
| GB | 2 340 574 | A | 2/2000 |
| JP | 541426 | | 8/1979 |
| WO | WO 97/41377 | | 11/1997 |
| WO | WO 01/73331 | | 10/2001 |

* cited by examiner

COMPOSITE LOW CYCLE FATIGUE COILED TUBING CONNECTOR

CROSS REFERENCE TO RELATED APPLICATIONS

The present application is a continuation application of U.S. patent application Ser. No. 10/394,392 filed Mar. 21, 2003 now abandoned.

FIELD OF THE INVENTION

The present invention relates to a tubing connector suitable for use with coiled tubing in oil and gas well operations.

BACKGROUND OF THE INVENTION

Coiled tubing is used in maintenance tasks on completed oil and gas wells and drilling of new wells. Operations with coiled tubing ("CT") involving upstream oil and gas recovery requires the capability to make butt or girth joints in the tubing for a variety of reasons. In particular, for offshore applications, the limitations on crane hoisting load capacities necessitates the assembly of two or more spools of coiled tubing once they have been delivered on deck.

There are two basic means to effect a girth joint connection. One way is by welding and the other involves the use of a spoolable mechanical connection. This may include the need for advanced machine welding processes, namely orbital tungsten inert gas ("TIG"), for onshore welded connections. These exhibit a low cycle fatigue ("LCF") life that is in the range of 50% to 60% of non-welded tubing. This magnitude of fatigue performance is twice the minimum value of what is generally accepted for welded connections made by the manual TIG process, which is 25% for manual TIG.

TIG welding requires skilled labor and great care in edge preparation. It is also susceptible to welding flaws if the shielding gas became deflected from a crosswind. For offshore applications where storms are frequent, an enclosed habitat would be required. In general, the logistics of performing orbital TIG offshore is significantly more complex.

The coiled tubing industry has developed many different and successful mechanical methods for joining coiled tubing to fittings and attachments. Among these are the familiar roll-on and dimple connectors that have been in service for many years. However, the development of a mechanical connector that can be plastically spooled repetitively on and off a working reel, has not met with similar success. The number of plastic bending cycles without failure of these mechanical connections was insufficient from both a practical, economic and safety point of view. This means that their LCF life was less than the 25% of tubing life achievable on average for manual TIG girth welds.

Therefore, a need exists for a connector that has elastic and plastic bending response that is optimized. Moreover, these connectors need an increased LCF life, better axial loading, and better corrosion resistance compared to that of the coiled tubing material and connectors of the prior art.

SUMMARY OF THE INVENTION

The present invention consists of a mechanical connection between two lengths of coiled tubing that may also be referred to as a composite LCF-CT connector. Its flush outer diameter with the tubing will enable the connector to pass through stuffing boxes and blow out preventers without obstruction. It is spoolable because it can be bent repeatedly over a CT working reel to a strain level that exceeds the yield strain of both the CT and the body of the connector for more than two times the number of bending cycles achieved by any other known connector design.

Although there are many unique innovations and engineering principles incorporated in its design, the connector of the present invention may include conventional mechanical methods such as a dimple connection for attaching the two coiled tubing ends to the body of the connector.

The elastic and plastic bending response of the connector of the present invention may be optimized by matching the bending stiffness, EI, and plastic bending moment, Mp, of the connector body and adjoining coiled tubing. Furthermore, the present invention may benefit from a greater LCF life by incorporating special variable radius fillets, increased wall thickness and reduced outer diameter in the connector body, special transition or entry sections and/or increased span between CT sections to achieve more uniform bending strain distributions and reduction of stiffness gradients at prior failure locations.

Some of the features of the present invention include the length of connector, the optimized stiffness variation along its length, appropriate material selection and strategic matching of connector physical dimensions with individual CT diameters, wall thickness, and strength grade. Those skilled in the art note that the CT outer diameter must be within the inner diameter of these entry sections to allow for the connection. In addition to featuring a substantially increased LCF life, the connector satisfies the axial loading, internal and external pressure capacities required of the CT string as well as a superior corrosion resistance compared to that of the coiled tubing material.

The present invention provides a coiled tubing connector having a body and a plurality of end transitions connected to the body wherein the connector has a LCF life of at least 30%, more preferably at least 40%, most preferably at least 50% of the CT life. Further design refinements indicate that 50% of the LCF life of the CT is possible. The connector may contain plurality of dimple connections capable of attaching two coiled tubing ends to the body of the connector. In a preferred embodiment, this LCF life is accomplished in part by at least two shoulders on the body that form an annular void between the shoulders. These shoulders preferably have average fillet radii of at least ¾ inches. The annular void is back filled with a composite elastomer/metal construction having a low Modulus, E, and negligible resistance to bending.

The entry sections preferably have a plurality of longitudinal axial slots. Moreover, the connector may include a plurality of centralizers about an exterior of the body. Each centralizer may have a plurality of chamfered edges and these centralizers may be assembled with a tongue-in-groove assembly and a plurality of socket head set screws. Similarly, the connector may have a plurality of elastomer spacer rings molded between centralizers about an exterior of the body.

The present invention takes advantage of dimensions that are inventive when compared to the dimensions of the connectors of the prior art. For example, when used with coiled tubing, it is possible for the connector body to have an outer diameter that is smaller than the outer diameter of the coiled tubing. The outer diameter of the CT may be accommodated by the entry and end sections and the outer diameter of the body will be tapered to a smaller diameter in these situations. In a preferred embodiment, the body has an outer diameter of about three-fourths (¾) of the CT and/or a wall thickness about two times greater than that of the CT. The connector may be greater than about 13 times the diameter of the CT in length wherein body is preferably at least about 8 times the diameter of the CT in length and the each end transition is at least about two and one half (2½) times the diameter of the CT in length. The connector is preferably a composite of fluoroplastics or aluminum alloy centralizers and most preferably X750 alloy body.

DETAILED DESCRIPTION OF PREFERRED EMBODIMENT

Figure 1:
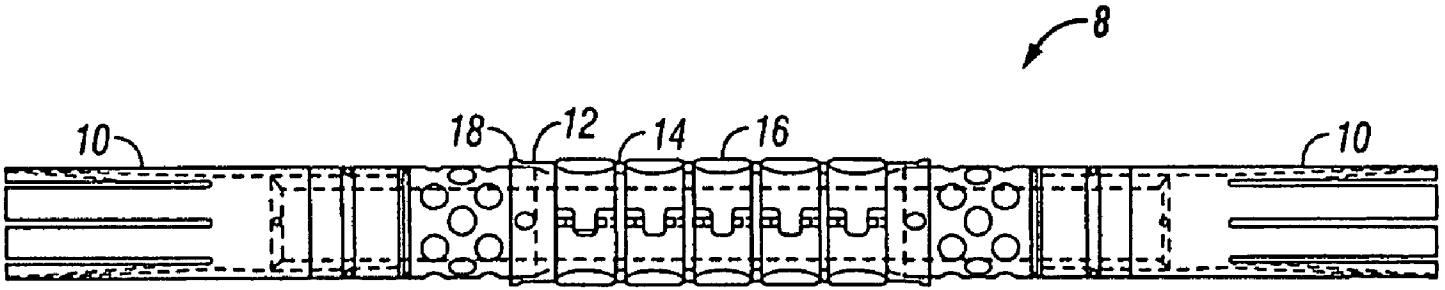
FIG. 1 is a side view of a preferred embodiment of the connector with a hidden line cross-section along the longitudinal axis.
Figure 2:
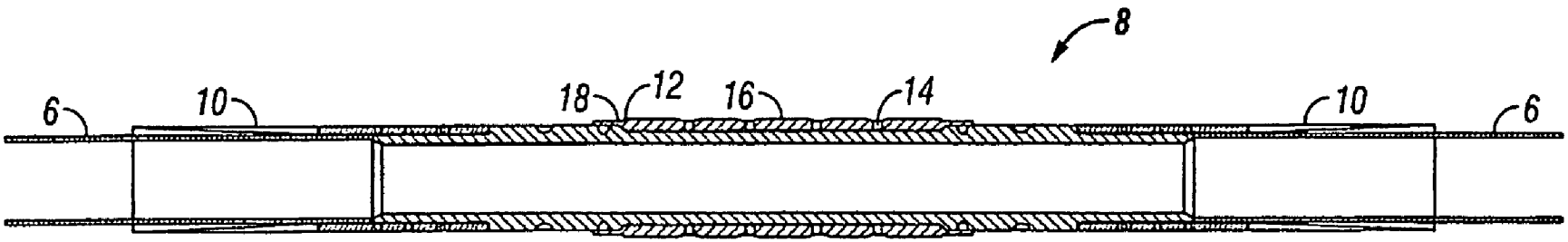
FIG. 2 is a cross-sectional view along the longitudinal axis of a preferred embodiment of the connector.

FIGS. 1 and 2 are a side view with hidden longitudinal cross-section and a cross-sectional view, respectively, of a preferred embodiment of the present invention. As shown from left to right, there is are entry sections 10 on the body 14 of the connector 8. Moreover, centralizers 16 are shown in an annular void between the shoulders 18 of the body 14 of the connector 8. Moreover, an elastomer backfill 12 is shown in the annular void between the shoulders 18. These elements will be discussed in greater detail below.

The selection of the optimum materials of construction is important to the formation of the connector 8. For acceptable plastic bend fatigue performance, the connector material exhibits plasticity properties such as a high plastic strain ratio and low cold-work-hardening rate. These material parameters define the "drawability" and "stretchability" respectively of the connector material.

Furthermore, the connector 8 should exhibit a high resistance to both wall thinning and loss of ductility under cyclic plastic strain loading. Simultaneously, the connector material must exhibit sufficient tensile strength and fracture toughness to accommodate the normal loading incurred by the coiled tubing string during service. Ideally, the material is also resistant to corrosion attack. Finally, for mechanical design reasons discussed in detail below, the material must be heat treatable so that the optimum yield strength can be specified to enable the desirable matching of plastic bending moment, Mp, with that of the coiled tubing. A low cold-work-hardening rate characteristic can limit the extent to which a mismatch in Mp might occur due to cyclic plastic bending. The X750 alloy is a preferred material for the connector 8 because it exhibits all of these desirable characteristics.

In the preferred embodiment, the outer diameter ("OD") of the body 14 of the connector 8 should be less than that of the outer diameter of the coiled tubing ("CT") 6 as shown in FIG. 2. The outer diameter of the CT 6 may be accommodated by the inner diameter of the entry and end sections 10 and then a taper to a smaller diameter of the body 14 is preferable. However, since the outer diameter of the coiled tubing string should also be continuous across the connector 8, an appropriate material should be selected to fill the annual void created by the reduced OD of the connector body 14 between the shoulders 18. This material should exhibit a low Modulus of Elasticity ("Young's modulus, E") yet have sufficient strength to sustain the radial compressive forces exerted by the seals in the stuffing box so as to retain the well bore pressure confinement necessary during most CT operations A backfill 12 of this annular void is also most preferable to centralize the connector 8 as it passes through the stuffing box seals and blow out preventers without obstruction. A material other than a steel alloy is preferable to meet these requirements. A composite material construction is a preferred material for this construction. The material(s) selected for this "centralizing" backfill include high temperature and corrosion resistant elastomer such as fluoroplastics or aluminum alloys.

The present invention benefits from the removal of the multiple ribs that were machined integral with the body 14 of the connector 8 of the prior art. In addition to contributing to the undesirably high stiffness of the connector 8, these ribs and small constant radius fillets introduce numerous stress raisers that are a cause of the unacceptably low bend fatigue life in the Comparative Example #1 discussed below that was obtained during LCF testing. The relatively short and stiff transition section used in prior art construction constitute a "hard" entry section that induced large local radial plastic flow in the CT which limited the useful LCF life due to excessive ballooning.

Moreover, the present invention offers a large fillet of variable radius at the shoulders 18, most preferably about ¾ inches average, which was absent in the connectors of the prior art. The combination of this element and the removal of the multiple ribs as previously noted moved the location of fatigue failure away from the body 14 of the connector 8. In the first optimization of the present invention, the maximum achievable fatigue life was now determined by failure in the coiled tubing rather than in the connector 8.

Another aspect of the present invention is to extend the entry or transition sections 10 of the connector 8. This improvement over the prior art reduces the magnitude of the force intensity of the couple that acts to transfer the plastic moment between coiled tubing and connector body 14 during bending. The reduction in these equivalent concentrated reactions of this force couple resulting from a larger distance between them is sufficient to limit ballooning in the CT to acceptable levels. This precludes preferential fatigue cracking at the reaction points such that the maximum LCF of the connector 8 is now determined by the combined effect of stiffness change and any residual stress concentration remaining at the run out of the fillets at connector body shoulders 18.

Another aspect of the present invention is the prevention of the formation of local plastic hinges that would induce larger plastic bending strains than those in the remainder of the tubing string. Such amplified bending strains would constitute "hot spots" for early fatigue failure. To minimize the propensity for local hinge formation, it is important to ensure that the elastic bending stiffness, as measured by the product EI of the modulus E and the moment of inertia, I, remains as uniform as possible over the length of the connector 8 and adjoining coiled tubing.

Since the bending deformation of the tubing strings begins first as an elastic curve before a permanent or plastic deformation occurs, a uniform elastic stiffness, EI, will mitigate against the formation of a point of increased bending flexure that would subsequently transform into a localized plastic hinge. Ensuring a uniform elastic curvature avoids sensitizing the connector 8 to local hinging prior to subsequent plastic deformation.

One of the connector optimizations, therefore, entails a revision to the outer diameter and wall thickness dimensions of the connector body 14 such that its elastic stiffness is matched with that of the adjacent coiled tubing. This design condition benefits from a reduction in the outer diameter compared with that of the coiled tubing and an increase in wall thickness. The outer diameter of a preferred embodiment of the body 14 of connector 8 is about three quarters (¾) of the outer diameter of the CT and the wall thickness of a preferred embodiment of the body 14 of connector 8 is greater than about one and one-half times that of the CT more preferably greater than about 2 times the wall thickness of the CT.

Another aspect of the present invention is plastic bending moment distribution. Spooling the connector 8 and adjoining coiled tubing on the working reel and over the guide arch ("gooseneck"), requires bending beyond the elastic limit, beyond the yield strength of the material, for both the connector body 14 and the coiled tubing. This typically results in a plastic strain for the coiled tubing in the range of about 2% to about 3%. The internal resistance afforded by the coiled tubing and connector 8 to plastic bending deformation is measured in terms of a plastic moment, Mp. To preclude the formation of local plastic hinges once yielding in bending has occurred, the distribution of Mp must preferable be as uniform as possible over the length of the connector 8 and adjoining coiled tubing.

In addition, the connector 8 also benefits from a matching of the plastic bending moments for the connector 8 with that of the coiled tubing. Because of a differing Modulus ("E") and yield strength, two material properties that together with the physical dimensions determine the value of Mp, this also dictates that the main body such as the central section of the connector body 14 be appreciably smaller in outer diameter compared with the coiled tubing. This is consistent with the requirements for matching EI although the dimensions would not be identical. Since Mp includes the yield strength, an exact match can be achieved by adjusting the value of the yield strength to compensate for the slight differences in cross-sectional dimensions.

The mechanical design of the connector 8 includes satisfying mechanical and structural strength requirements. The axial tensile and compressive strengths of the connector 8 are designed to be comparable with the specified minimum strengths of the coiled tubing. The burst and collapse pressure capacity of the connector 8 will exceed that of the coiled tubing in view of the equivalence of yield strengths of the connector 8 and coiled tubing coupled with a smaller diameter, heavier wall thickness and smaller D/t ratio for the connector 8.

Any welded or mechanical connection made in a coiled tubing string should be able to pass through an external seal device known as the "stuffing box" without obstruction. Hence there is a need for a flush outer diameter between the connector 8 and CT.

Since the length of the stuffing box seal is less than that of the connector 8, the possibility exists for the connector body 14 to bind or hang-up in the stuffing box if the outer diameter of the connector body 14 is much less than the inner diameter of the stuffing box seal. Such interference may readily occur at the shoulders 18 of the connector body 14 if it is free to deflect sideways during passage through the stuffing box. To avoid this situation, the annular void existing between the connector body shoulders 18 and a line drawn flush with the outer diameter of the coiled tubing, is back-filled with centralizer rings 16.

Figure 3:
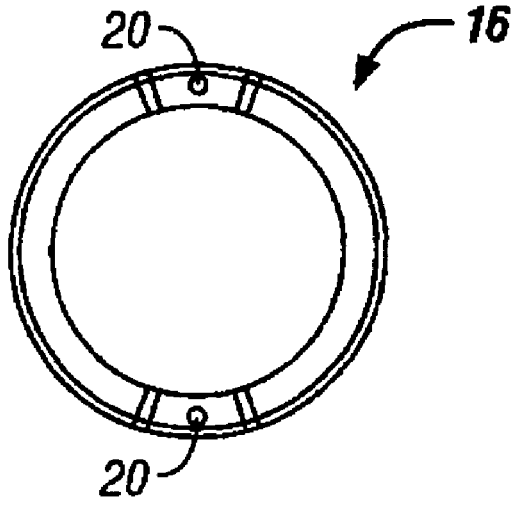
FIG. 3 is an assembly view of a preferred embodiment of a centralizer.

The outer diameters of the centralizers 16 contain a chamfered edge on either side. The resulting crowned profile will further preclude any tendencies for binding with the stuffing box seals. The inside surfaces of the centralizers 16 are similarly crowned to avoid interference with between the centralizer 16 and connector body 14 during bending deflections. The radius-curved profile for these chamfers is also compatible with that of the fillet at the shoulders 18 of the connector body 14, preferably about ¾ inches average radius. This design should prevent any tendency for wedging action that might pry the end centralizers 16 apart as they are compressed against these shoulders from frictional forces arising in the stuffing box or during bending deflections of the connector 8. As shown in the assembly detail in FIG. 3, the centralizers 16 are machined in two halves that are joined together by a tongue-in-groove assembly and fixed in place with socket head set screws 20.

The centralizers 16 have been designed with sufficient radial and axial clearance to avoid mutual interference during bending deflection of the connector body 14. The material of construction for the centralizers 16 should be selected to exhibit a lower E Modulus so that the centralizers 16 will readily deform without excessive bending resistance in the event that the connector 8 is deflected beyond design values. The centralizers 16 should also exhibit sufficient compressive strength to support the radial loads induced by stuffing box seals or other elements such as pipe rams in the BOP should the connector 8 be situated at these locations when the seals or rams become energerized. Though those skilled in the art will recognize that other materials including elastomers may be used, the preferred embodiment of the centralizers 16 is aluminum alloy 7075 T6.

During normal coiled tubing operations, radial compression forces act on the coiled tubing as it is bent over the gooseneck and wound onto the working reel. Under this lateral loading action, the centralizers 16 cannot react strongly against these forces because of the bore radial clearance with the connector body 14 and because the "softer" centralizer 16 material will deform more readily than the adjacent shoulders 18 of the connector body 14.

A free body diagram of forces and reactions for the connector 8 assembly under such loading could be modeled as a simply supported curved beam with axial load and bending moments applied at each end of the connector 8. The reaction forces against the applied loads would then consist of point loads concentrated at each of the two shoulders 18 of the connector body 14. Applying basic beam theory for statically indeterminate beam loading or by finite element analysis ("FEA"), the bending curve shape and deflection of the connector body 14 can be calculated as a function of connector span length.

The local radial deflection at the midpoint of the connector body 14 is noticeably greater than that at the locations along the length of the connector 8 assembly. This indicates that the local bending strains are higher and premature fatigue cracking could therefore be anticipated at this location. This showed that increasing the length of the connector 8 would serve to reduce the severity of bending strain amplification at mid-section of the connector 8 and that there is an optimum length for the connector 8 for which the bending strain is distributed uniformly along its length. In a preferred embodiment, the body 14 of the connector 8 is at least about 8 times the CT diameter in length. In a most preferred embodiment, the body 14 is at least about 9 times the CT diameter in length. The connector 8 having a body 14 with entry sections 10 is preferably at least about 13 times the CT diameter in length and most preferably at least about 15 times the CT diameter in length.

As explained above, the preferred mechanical coiled tubing connector 8 exhibits a uniform elastic stiffness and plastic bending moment distribution. This is achieved for the main or central body 14 of the connector 8 by matching EI and Mp of the connector and CT. To reduce the susceptibility for the initiation of fatigue failure at any location, it is also important that any gradients in material or geometric properties be as gradual as possible at this location. Unlike a butt-welded connection, however, it is extremely difficult to achieve a perfect match of these properties at the transition or entry section 10 between the coiled tubing and connector 8. It is also very difficult to eliminate all gradients at these sections. The present invention avoids fatigue failure in the body 14 of the connector 8 if installed in a CT string that has been subjected to prior fatigue loading and/or material degradation such as corrosion pitting or stress cracking. Plastic bend-fatigue failure and/or excessive ballooning within this transition remains as the limiting condition on maximum serviceability for the connector 8 when installed in new CT.

The entry section 10 at each end of the connector 8 is attached to the body 14 by way of a threaded connection. This feature enables transition sections of different designs to be tested for relative LCF and ballooning response, sometimes using two different entry sections on a single connector test specimen. The present invention may eliminate the severe localized ballooning obtained after the first modification to the original connector.

The LCF test performed on a second connector, as shown in the Examples, for which no design modifications to the entry sections 10 were made, resulted in early failure due to excessive diameter growth in the coiled tubing at the point of first contact between the connector 8 and coiled tubing. The accentuated plastic bending strains, induced by such ballooning, will in turn lead to early fatigue crack initiation and propagation in the coiled tubing at these locations.

Therefore, the entry section 10 cannot be too short and stiff. The present invention teaches that a gradient in stiffness at this location that was too abrupt to avoid excessive plastic flow in the radial direction will cause ballooning. As a result, the present invention both reduces the stiffness gradient and provides for a distributed first point of contact between the tubing and connector 8 after successive cycles.

To achieve these two design objectives, the entry or transition section 10 length of the present invention is more than doubled, thereby greatly reducing the stiffness gradient. The preferred length for the entry sections are at least about two and one-half (2½) times the diameter of the CT, more preferably at least about 3 times the diameter of the CT, most preferably at least three and one-half (3½) the diameter of the CT. To reduce this gradient further and to avoid repetitive ratcheting of plastic flow in the radial direction at the same location, namely the first point of contact between entry section 10 and CT, longitudinal axial slots 22 may be machined in the tapered portion 24 of the entry section 10. A close up view with hidden cross-section of the entry section 10 with longitudinal slots 22 is shown in FIG. 4.

Figure 4:
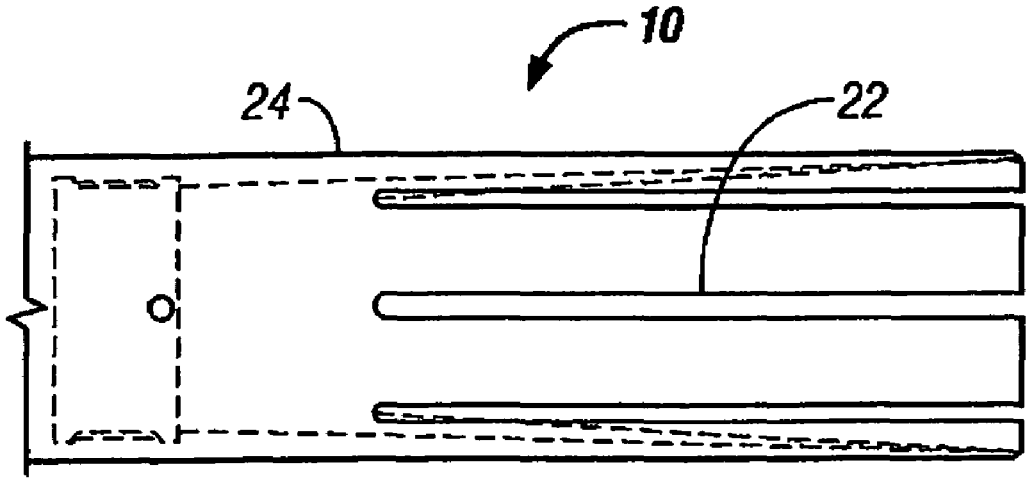
FIG. 4 is side view with hidden cross-section of a "soft" entry or transition section with longitudinal slots.

The slots 22, whose width and length dimensions were strategically selected, give rise to a fluted entry section 24 shown in FIG. 4 comprised of multiple fingers. These fingers act as small cantilever beams while reacting against the inside surface of the coiled tubing during plastic bending deformation. Since these cantilever beams are themselves deflected plastically, albeit to a lesser degree than the coiled tubing, the first point of contact for the bending reaction force during a subsequent bending cycle will be displaced further in the direction of the connector body. The resulting ratcheting of radial plastic flow in the coiled tubing will therefore be concentrated at a different location adjacent to the first last point of contact. The ballooning measurements reported in the Examples, which includes one of the two entry sections that comprises the fluted design, substantiates the expectation of reduced ballooning severity based on these theoretical design concepts.

For similar reasons, a tapered entry section 24 of similar or longer length is fabricated but without the slots 22 used for the "soft entry" section. This "extended taper" soft entry sections may be attached as an alternate entry section to the connector body 14. Since fatigue failure may occur in the coiled tubing at the "soft entry" section, the "extended taper" soft entry section may exhibit still better performance than the fluted entry 24. However, fatigue testing has not yet been performed to measure the LCF performance of this design. With respect to FIG. 4, it is also notable that the entry section 10 may constitute a venturi with respect to internal fluid flow because of the gradual taper in wall thickness on the inside surface as shown by the hidden lines of FIG. 4.

Any connection in coiled tubing must ensure that there is no leakage path for fluids penetrating the wall of the connector 8. Leakage under either internal or external pressure is not permitted. The connector of the prior art may spring a leak after only a few bending cycles. Three root causes have been identified for this seal failure: 1) The lip seal stack used did not energize sufficiently at low pressure; 2) The internal surface of the coiled tubing was not adequately prepared to enable a good seal (i.e. the internal weld flash at the ERW seam weld was not reamed flush with the inside tubing wall); and 3) The major contributing factor was excessive ballooning at the seal surface section of the connector and a tendency for the end of the CT to flare outward under the prying action created during bending of the connector assembly.

The design modifications built into the connector 8 of the present invention mitigate against the various factors that impacted negatively on the seal integrity of the connector 8. For example, the severity of the prying action has been reduced to acceptable levels by extending total length of engagement by overlapping the connector 8 and coiled tubing. With reference to FIGS. 1-2, the distance from the shoulder 18 in the body 14 of the connector 8 to the start of the entry section 10 is longer than the original design. Furthermore, in one variation of the connector design, a dovetail butt joint between the end of the coiled tubing and abutting shoulder 18 in the body 14 of the connector 8 indicates a square shoulder that would be replaced with a negative bevel. The coiled tubing may be given a positively beveled edge preparation such that any radial displacement of the CT would be prevented after engaging the two beveled edges. Moreover, a new internal pipe reamer may be included for more complete removal of the internal ERW weld flash. This includes a new clamping device to circularize the normally out-of-round coiled tubing thereby enabling a uniform reaming to provide a smooth seal surface on the inside of the CT. Similarly, the "soft entry" section has eliminated the unacceptably large ballooning response along the seal section thereby maintaining uniform contact between the seals and inner surface of the CT. Finally, additional O-ring backup seals may be added in tandem to the lip-seal stack to ensure seal integrity under low internal pressures.

EXAMPLES

Low cycle fatigue life is determined using a CT Fatigue Testing Fixture, Broken Arrow Model, Ser. No. 002, bend fatigue-testing machine in Calgary, Alberta. Testing was performed at various bend radii typically 72 and 94 inches for the 2⅞ inches diameter coiled tubing used in offshore well interventions. A 7-foot long full sized CT specimen was used. The ends of the test specimen were sealed to enable an internal pressure to be applied with pressurized water while the specimen is subjected to cyclic bending from straight to curved and back to straight. This represented one (1) bend fatigue cycle and three (3) cycles corresponds to one (1) trip in and out of a well bore. Fatigue failure was obtained upon the loss of internal pressure that occurs immediately upon the formation of a crack or "pin hole" in the wall of the tubing. The actual allowable number of fatigue cycles (or equivalent trips) was obtained by dividing the cycle life to failure by a suitable factor of safety. This factor is typically in the order of 3. It is calculated on the basis of a risk or probability of failure of one in one thousand.

At a sufficiently large internal pressure, a tubing's response to plastic bending can result in a permanent radial plastic flow of material. This growth in outer diameter is referred to as "ballooning". Exceeding a maximum allowable growth in outer diameter at any location along the test specimen constitutes second criterion of failure.

Table 1 summarizes the fatigue test results for the various CT connector design innovations including the first test performed on a connector of the prior art shown herein as a comparative example:

inches, the number of allowable fatigue cycles could be expected to be reduced to only 5 or 6 trips. This would generally be considered unacceptable for use in coiled tubing operations.

The first major design change, Example #2, eliminated all of the ribs that had been machined integral with the central or main section of the connector body. A radiused fillet was also incorporated at the two shoulders on either side of the central section of the connector body. These improvements increased the bend fatigue performance of the connector by 71%. These design modifications also moved the weakest link in the connector assembly from the connector to the coiled tubing where it overlaps with the entry sections of the connector. Assembly of a new test specimen, Example #4, with new coiled tubing and the same connector body, resulted in a small incremental gain of only 24 cycles. The maximum LCF life achieved with the connector body was therefore 116 cycles or nearly 45% of the life of the coiled tubing.

With the LCF failure location moving to the coiled tubing, a growth in diameter, 0.135 inches, at the failure location was introduced that was larger than the maximum allowable, 0.100 inches. Excessive ballooning was subsequently elimi-

TABLE 1

2⅞" Composite LCF-CT Connector Fatigue Test Results

| Example Specimen ID | Bend Radius (in) | Internal Pressure (psi) | Cycles to fatigue fail (equiv. Trips) | Balloon Max (in) | % of CT life | Comments |
|---|---|---|---|---|---|---|
| #1 Comparative | 94 | 1500 up to seal fail., 800 psi @ seal leak | 98 (33) | N/A | 21.6 | 94 inch bend radius is less commonly used in practice. Major fatigue fracture at root of shoulder and first integral rib. |
| #2 First design mod. 1st test | 94 | 1500 | 168 (56) | 0.021 | 37 | All integral ribs machined off flush with OD of connector body. Fillet radius increased. Fatigue failure in CT at entry section. Ballooning in CT at entry section. |
| #3: First design mod. 2nd test | 72 | 1500 | 92 (30) | 0.135 | 35.4 | Same connector as #2, 1st test, with new CT. Failure in CT at entry section. Max allowable ballooning of 0.100" exceeded |
| #4 First design mod. 3rd test | 72 | 60 | 24 (8) | 0.035 | 44.6 | Same connector as #3, 2nd test, with new CT. Failure in connector body at sharp shoulder fillet. % of CT life based on total cycles (116) sustained by connector body |
| #5 Second design mod. 1st test | 72 | 1000 | 16 (5) | N/A | 6.2 | Design modification retained 2 integral ribs at equal spacing. Result not expected to yield high LCF. Result showed detrimental effect of reducing span length of CT body. |
| #6 100 ksi CT 2⅞ × 0.156 | 94 | 1000 | 454 (151) | N/A | 100 | Fatigue "pin hole" failure in extrados |
| #7 100 ksi CT 2⅞ × 0.156 | 72 | 1000 | 260 (87) | N/A | 100 | Fatigue "pin hole" failure in extrados |
| #8 Third design mod. 1st test | 72 | 1000 | 105 (35) | 0.005 | 40.4 | Test incorporated "soft" entry section on 1 side & "extended taper" entry section on other side. Fatigue failure at ID corrosion pit in used CT at "soft" entry section. |
| #9 Third design mod. 2nd test | 72 | 1000 | 5 (1) | 0.005 | 42.3 | Continued with #8 connector and new CT. Fatigue crack in connector body at shoulder fillet. % of CT life based on total cycles sustained by connector body (110 cycles) |

The LCF for the prior art connector manufactured by BD Kendle Engineering, shown as Example #1 Comparative, was tested without any modifications on a larger bend radius than what is normally encountered in practice for a 2⅞ inch CT string. Even at this larger radius, this connector would only permit a maximum of 10 trips during well work over because a safety factor of at least 3 must be applied against the measured number of cycles to failure. If this connector were used in conjunction with the more common bend radius of 72 nated by the introduction of the "soft" and "extended taper" entry sections as shown in Example #8. However, a lower than maximum possible cycle life was obtained with this specimen because premature failure occurred in the used tubing that contained corrosion pits on the inside surface.

Example #5 showed that the central section of the connector body cannot contain any ribs machined integral with the connector body. To achieve the necessary centralization of the connector as it passes through stuffing boxes and BOP stacks, the connector incorporates separate components that are not rigidly attached to the connector body. Example #5 also provided test data to evaluate the effect of and optimize the connector body span length between shoulders.

Examples #8 and #9 confirmed the results obtained from Examples #3 and #4 which showed that the connector body is able to sustain at least twice the number of bending cycles, 44.6% and 42.3%, respectively, like Example #1, which is 21.6%.

Therefore, these Examples show that the present invention has a LCF life at least 30%, more preferably at least 40% of the bare tubing life. This is at least twice that of other known connectors. This LCF life is more preferably at least 60%. Test results have also shown that, unlike other connectors tested, the present invention can sustain a cyclic plastic bending moment with minimum propensity for excessive local diametral growth or formation of plastic hinge(s). This is an important requirement of any CT connector to ensure both internal and external seal integrity. Connectors designed and fabricated by others also exhibited loss of fluid during plastic bending deformation. Significantly, the LCF life of the connector exhibits a fatigue performance that is also greater than manual TIG girth welded joints that have out-performed the LCF life of existing mechanical connections.

One aspect of this invention is the super alloy X-750 that was selected for optimum plasticity, tensile and work hardening properties to ensure that other mechanical and structural strength requirements are satisfied. Those skilled in the art will recognize that substitution or inclusion of additional materials with these properties is to be considered to be within the scope of the invention.

The elastic and plastic bending response of the connector of the present invention has been optimized by matching the bending stiffness, EI, and plastic bending moment, Mp, of the connector body and adjoining coiled tubing. The ability to heat treat the X-750 alloy together with its low work-hardening characteristics enabled the matching of Mp to be retained throughout consecutive plastic bending cycles.

Other design innovations incorporated in this invention for maximum LCF life, include large and variable fillet radii, increased wall thickness in the connector body, increased span to achieve more uniform bending strain distributions and reduction of stiffness gradients at prior failure locations. The notable aspects of this invention are therefore the length of connector, the optimized stiffness variation along its length, appropriate material selection and strategic matching of connector physical dimensions with individual CT diameters, wall thickness and strength grade. In addition to featuring a substantially increased LCF life, the connector satisfies the axial loading, internal and external pressure capacities required of the CT string as well as a superior corrosion resistance compared to that of the coiled tubing material.

While the foregoing is directed to various embodiments of the present invention, other and further embodiments may be devised without departing from the basic scope thereof. For example, the various methods and embodiments of the invention can be included in combination with each other to produce variations of the disclosed methods and embodiments, as would be understood by those with ordinary skill in the art, given the teachings described herein. Those skilled in the art recognize that the directions such as "top," "bottom," "left," "right," "upper," "lower," and other directions and orientations are described herein for clarity in reference to the figures and are not to be limiting of the actual device or system or use of the device or system. The device or system may be used in a number of directions and orientations.

What is claimed is:

1. A coiled tubing connector comprising:

a body comprising at least two shoulders forming an annular void between the shoulders, wherein the at least two shoulders each comprise a fillet;

a plurality of entry or transition sections connected to the body;

a plurality of centralizers about an exterior of the body, wherein the plurality of centralizers are capable of centering the connector as it passes through a stuffing box; wherein each centralizer comprises a plurality of chamfered edges.

2. The connector of claim 1 wherein the fillet has a variable fillet radii of average value at least ¾ inches.

3. The connector of claim 1 wherein the plurality of centralizers further comprises a composite of fluoroplastics or aluminum alloys.

4. The connector of claim 1 wherein the connector comprises X750 alloy.

5. The coiled tubing connector of claim 1, wherein each entry section comprises a plurality of longitudinal axial slots.

6. The coiled tubing connector of claim 5, wherein the body is back filled and molded with elastomer material.

7. A coiled tubing connector for use in connection with coiled tubing, wherein the connector has a connector cycle fatigue life and the coiled tubing has coiled tubing cycle fatigue life, the connector comprising:

a body;

a plurality of entry or transition sections connected to the body; and a plurality of centralizers about an exterior of the body, wherein the plurality of centralizers are capable of preventing the body from binding within a stuffing box;

wherein the connector cycle fatigue life is at least 30% of the coiled tubing cycle fatigue life; and wherein the body is back filled and molded with elastomer material.

8. The connector of claim 7 wherein each centralizer comprises a plurality of chamfered edges.

9. The connector of claim 8 wherein each centralizer is assembled in a tongue-in-groove assembly and wherein the connector further comprises a plurality of socket head set screws.

10. A connector for use with coiled tubing, wherein the coiled tubing has a coiled tubing outer diameter, the connector comprising:

a body wherein the body has a body outer diameter and an exterior;

a plurality of centralizers about the exterior; and a plurality of entry sections connected to the body, wherein the entry sections are adapted to be connected to coiled tubing;

at least two shoulders of variable radius forming an annular void between the shoulders;

wherein the body outer diameter is smaller than the coiled tubing outer diameter; and wherein the centralizers fill the annular void.

11. A coiled tubing connector system, comprising:

a first length of coiled tubing and a second length of coiled tubing; and a coiled tubing connector connecting the first length of coiled tubing and the second length of coiled tubing, the coiled tubing connector comprising, a body;

a plurality of entry or transition sections connected to the body;

a plurality of centralizers about an exterior of the body, wherein the plurality of centralizers are capable of centering the connector as it passes through a stuffing box.

12. The connector system of claim 11 wherein:

the first and second lengths of coiled tubing further comprise a coiled tubing outer diameter; and the body further comprises a body outer diameter of less than about three-fourths (¾) times the coiled tubing outer diameter.

13. The connector system of claim 11 wherein:

the first and second lengths of coiled tubing further comprise a coiled tubing wall thickness; and the body further comprises a body wall thickness greater than about two (2) times the coiled tubing wall thickness.

14. The connector system of claim 11 wherein:

the first and second lengths of coiled tubing further comprise a coiled tubing outer diameter; and the connector further comprises a length greater than about thirteen (13) times the coiled tubing outer diameter.

15. The connector system of claim 11 wherein:

the first and second lengths of coiled tubing further comprise a coiled tubing outer diameter; and the body comprises a length of at least about eight (8) times the coiled tubing outer diameter.

16. The connector system of claim 11 wherein:

the first and second lengths of coiled tubing further comprise a coiled tubing outer diameter; and each entry section comprises a length of at least about two and one-half (2½) times the coiled tubing outer diameter.

17. The connector system of claim 11 wherein the connector comprises X750 alloy.

18. The coiled tubing connector system of claim 11, wherein the first and second lengths of coiled tubing have a coiled tubing cycle fatigue life and the coiled tubing connector has a connector cycle fatigue life, the connector cycle fatigue life being at least 30% of the coiled tubing cycle fatigue life.

19. The coiled tubing connector system of claim 11, wherein the first and second lengths of coiled tubing have a coiled tubing cycle fatigue life and the coiled tubing connector has a connector cycle fatigue life, the connector cycle fatigue life being at least 30% of the coiled tubing cycle fatigue life, where the connector cycle fatigue life and the coiled tubing cycle fatigue life are determined using a CT Fatigue Testing Fixture, Broken Arrow Model, Serial No. 002, bend fatigue-testing machine.

20. The coiled tubing connector system of claim 11, wherein each entry section comprises a plurality of longitudinal axial slots.

* * * * *